US007316524B1

(12) United States Patent
Pikuet

(10) Patent No.: US 7,316,524 B1
(45) Date of Patent: Jan. 8, 2008

(54) TAMPING DEVICE

(76) Inventor: Kevin M. Pikuet, 44 Golden Rd., Rochester, NY (US) 14624

( * ) Notice: Subject to any disclaimer, the term of this patent is extended or adjusted under 35 U.S.C. 154(b) by 45 days.

(21) Appl. No.: 11/515,449

(22) Filed: Sep. 5, 2006

(51) Int. Cl.
*E01C 19/40* (2006.01)
*E01C 19/38* (2006.01)
*E01C 19/34* (2006.01)

(52) U.S. Cl. ..... 404/133.1; 404/114

(58) Field of Classification Search ..... 404/133.1, 404/114
See application file for complete search history.

(56) References Cited

U.S. PATENT DOCUMENTS 2,257,223 A * 9/1941 Borgmann ..... 404/133.1
3,109,354 A 11/1963 Van Kirk
3,483,805 A 12/1969 Hirn et al.
3,603,225 A 9/1971 Buck
3,673,931 A * 7/1972 Dening et al. ..... 404/133.1
3,856,426 A 12/1974 Waschulewski et al.
3,899,263 A * 8/1975 Briggs et al. ..... 404/133.1
4,170,427 A 10/1979 Grane
4,499,779 A * 2/1985 Maass ..... 404/133.1
4,702,641 A * 10/1987 Naser et al. ..... 404/97
5,115,536 A * 5/1992 Jarvis ..... 15/235.8
5,149,225 A * 9/1992 Artzberger ..... 404/133.1
5,393,168 A * 2/1995 Jarvis ..... 404/97
D393,864 S 4/1998 Waldenberger et al.
5,890,834 A * 4/1999 Waldenberger ..... 404/133.1
5,984,571 A * 11/1999 Owens ..... 404/97
6,000,879 A 12/1999 Greppmair
6,200,065 B1 * 3/2001 Eitzen ..... 404/114
6,443,651 B1 * 9/2002 Greppmair ..... 404/133.05
6,827,523 B2 * 12/2004 Medendorp ..... 404/97
2003/0185627 A1 * 10/2003 Hausler et al. ..... 404/133.1

* cited by examiner

*Primary Examiner*—Raymond Addie

(57) ABSTRACT

A tamping device for tamping of asphalt or stone includes a motor being coupled to a drive shaft. The motor rotates the drive shaft when the motor is actuated. A sleeve is coupled to the motor. The drive shaft extends through the sleeve. A transmission housing is coupled to the sleeve opposite the motor. The drive shaft extends into the transmission housing. A foot assembly is rotatably coupled to the transmission housing. An angle of the transmission housing and the sleeve is adjustable with respect to the foot assembly. The foot assembly vibrates when the motor is actuated to tamp the asphalt or the stone and the foot assembly is drawn across the asphalt or the stone.

11 Claims, 4 Drawing Sheets

TAMPING DEVICE

BACKGROUND OF THE INVENTION

1. Field of the Invention

The present invention relates to vibrating tampers and more particularly pertains to a new vibrating tamper for tamping stone or the edges of asphalt.

2. Description of the Prior Art

The use of vibrating tampers is known in the prior art. The prior art commonly teaches the use of a cam and a vertically sliding rod to force a foot to come off of and strike a surface to tamp asphalt or stone, which vibrates the entire device. While these devices fulfill their respective, particular objectives and requirements, the need remains for a device that has certain improved features that use off centered weights that are rotated to create the vibration. Additionally, the device incorporates a liquid supply assembly to supply liquid to the asphalt to inhibit the device from sticking to the asphalt.

SUMMARY OF THE INVENTION

The present invention meets the needs presented above by generally comprising a motor being coupled to a drive shaft. The motor rotates the drive shaft when the motor is actuated. A sleeve is coupled to the motor. The drive shaft extends through the sleeve. A transmission housing is coupled to the sleeve opposite the motor. The drive shaft extends into the transmission housing. A foot assembly is rotatably coupled to the transmission housing. An angle of the transmission housing and the sleeve is adjustable with respect to the foot assembly. The foot assembly vibrates when the motor is actuated to tamp the asphalt or stone and the foot assembly is drawn across the asphalt or stone.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
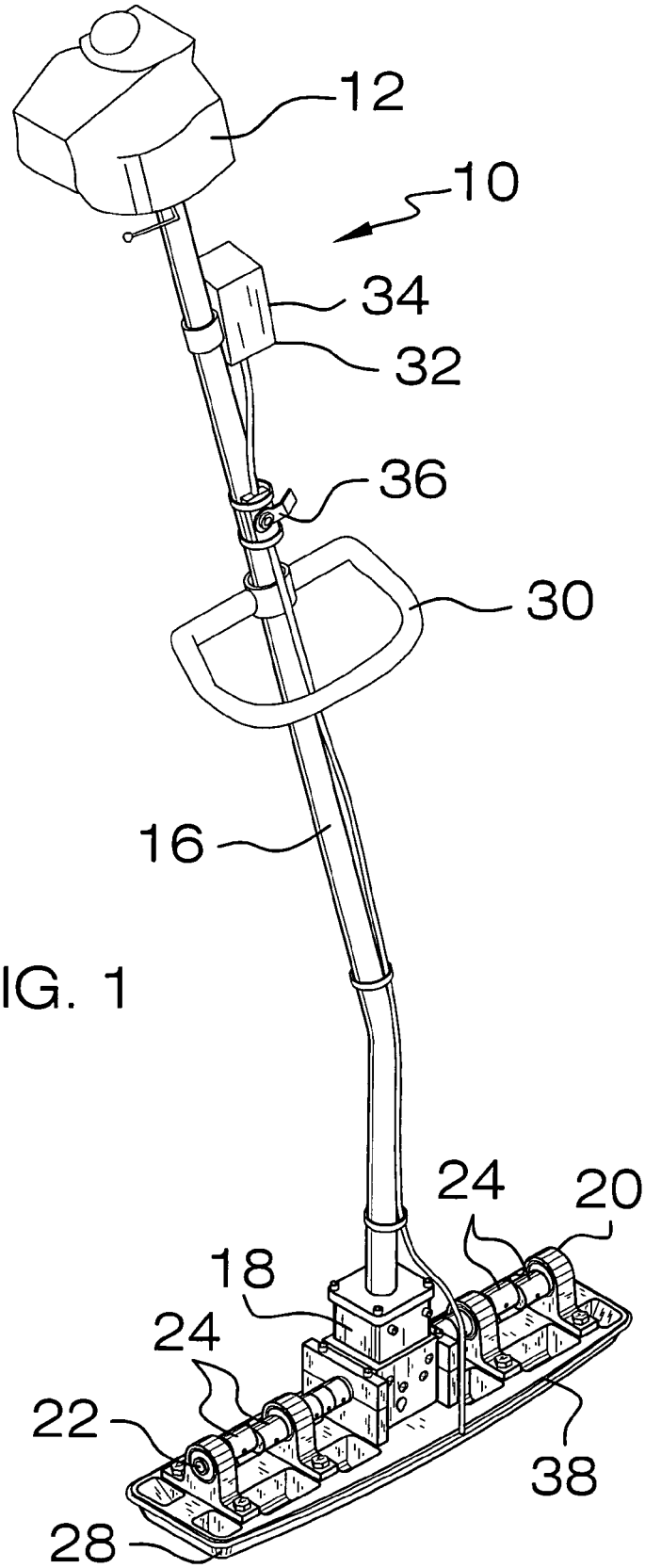
FIG. 1 is a perspective view of a tamping device according to the present invention.

With reference now to the drawings, and in particular to FIGS. 1 through 6 thereof, a new vibrating tamper embodying the principles and concepts of the present invention and generally designated by the reference numeral 10 will be described.

As best illustrated in FIGS. 1 through 6, the tamping device 10 generally comprises a motor 12 being coupled to a drive shaft 14. The motor 12 rotates the drive shaft 14 when the motor 12 is actuated. A sleeve 16 is coupled to the motor 12. The drive shaft 14 extends through the sleeve 16. A transmission housing 18 is coupled to the sleeve 16 opposite the motor 12. The drive shaft 14 extends into the transmission housing 18.

A foot assembly 20 is rotatably coupled to the transmission housing 18, wherein in an angle of the transmission housing 18 and the sleeve 16 is adjustable with respect to the foot assembly 20. The foot assembly 20 includes a transfer shaft 22 rotatably extending through the transmission housing 18. The transfer shaft 22 engages the drive shaft 14, wherein the drive shaft 14 rotates the transfer shaft 22. The transfer shaft 22 is positioned orthogonally to the drive shaft 14. Each of a plurality of weights 24 is coupled to the transfer shaft 22. Each of the weights 24 is positioned off center to vibrate the foot assembly 20 when the transfer shaft 22 is rotated. A tamping foot 28 rotatably receives the transfer shaft 22. The tamping foot 28 abuts and vibrates against asphalt or stone to tamp the asphalt or the stone when the transfer shaft 22 and the weights 24 are rotated.

A handle 30 is coupled to the sleeve 16. The handle 30 is graspable to facilitate manipulation of the sleeve 16, the motor 12 and foot assembly 20. A liquid supply assembly 32 is coupled to the sleeve 16. The liquid supply assembly 32 sprays a liquid on the asphalt around the foot assembly 20 to inhibit the foot assembly 20 from sticking to the asphalt.

Figure 2:
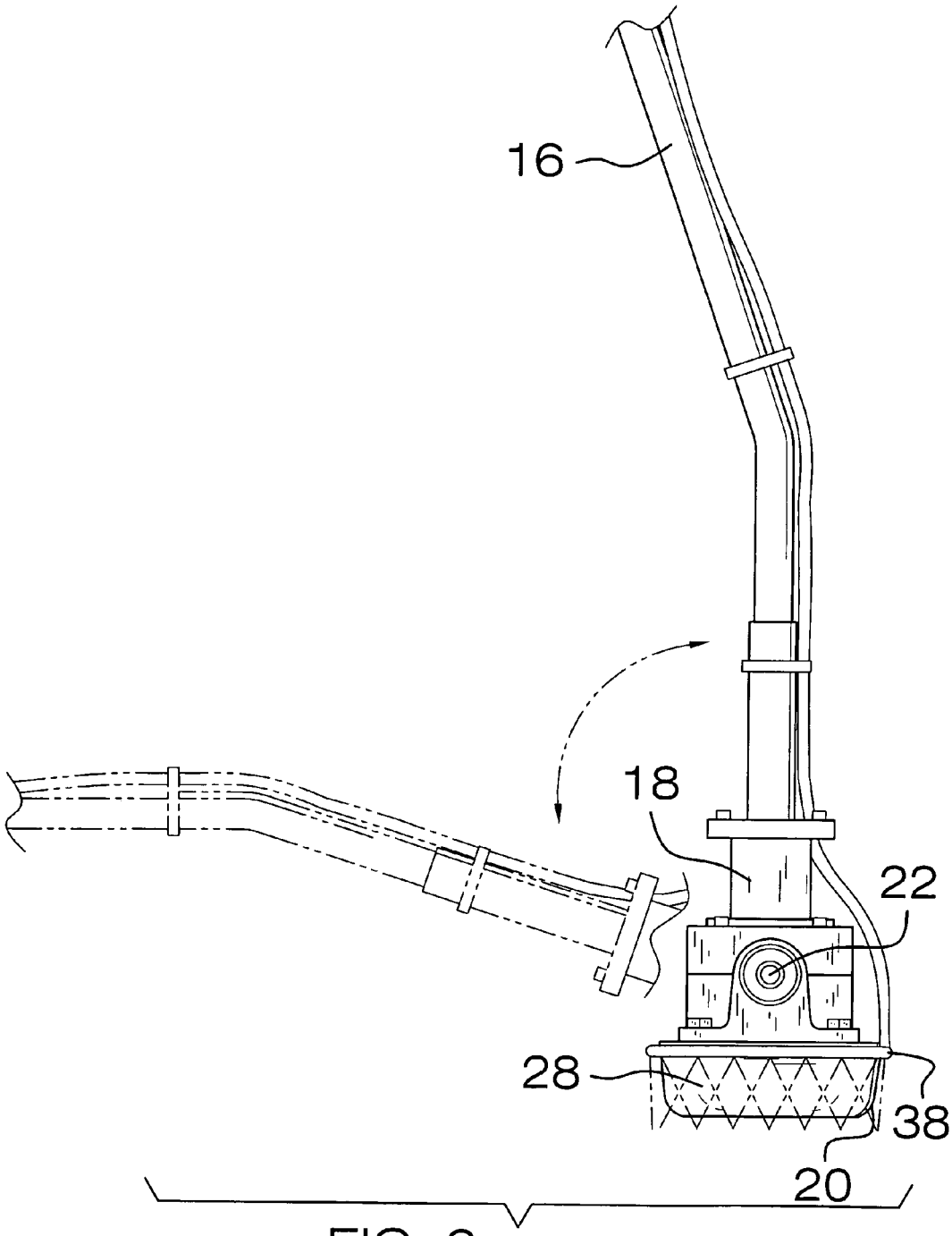
FIG. 2 is an enlarged side view of the foot assembly of the present invention showing the variation in angle attainable by the sleeve and the transmission housing with respect to the foot assembly.
Figure 3:
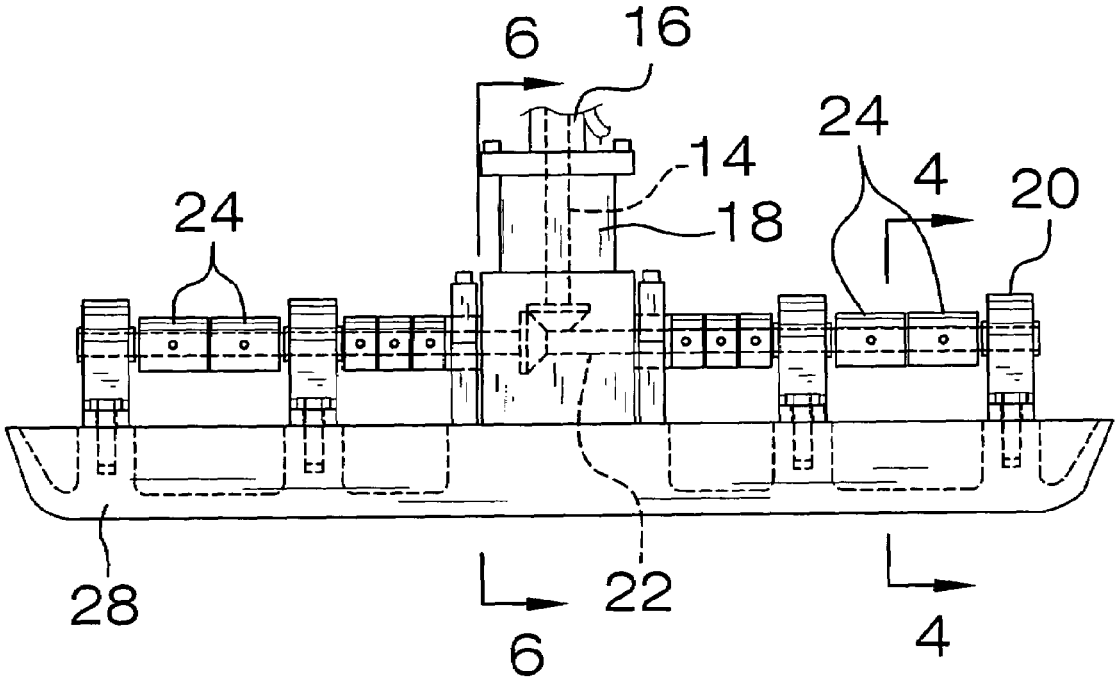
FIG. 3 is a front view of the foot assembly of the present invention.
Figure 4:
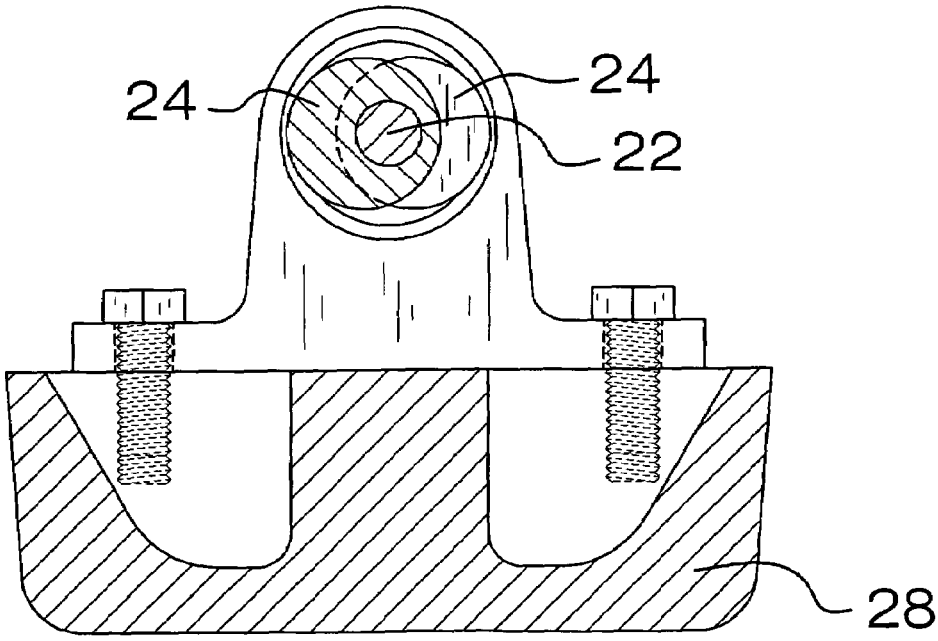
FIG. 4 is a cross-sectional view of the present invention taken along line 4-4 of FIG. 3.
Figure 5:
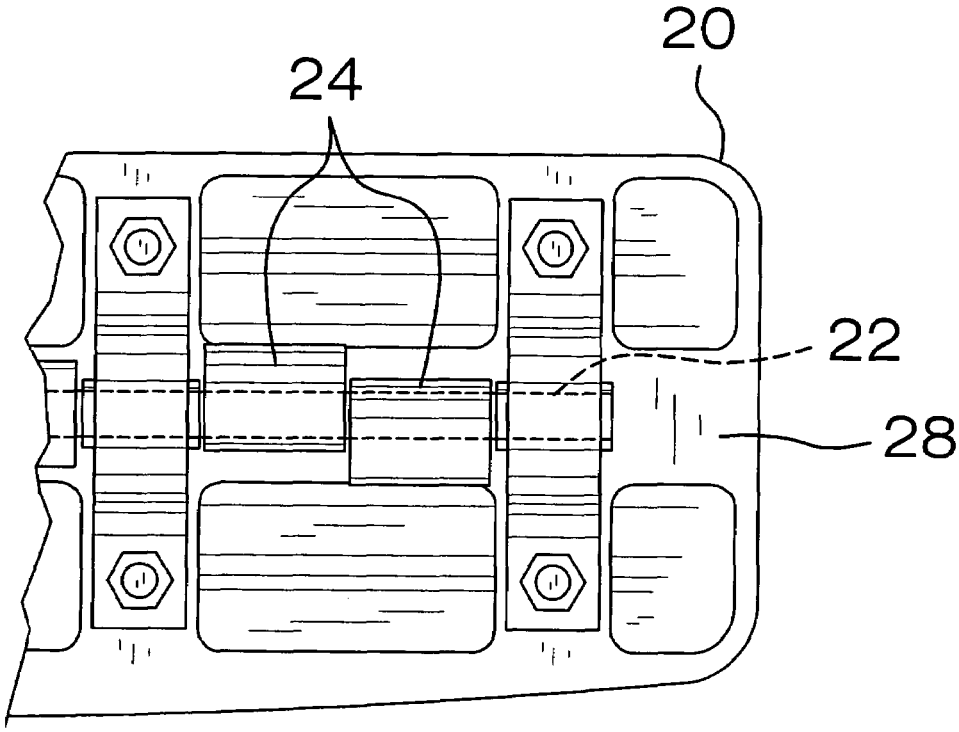
FIG. 5 is a top view of a portion of the foot assembly of the present invention.
Figure 6:
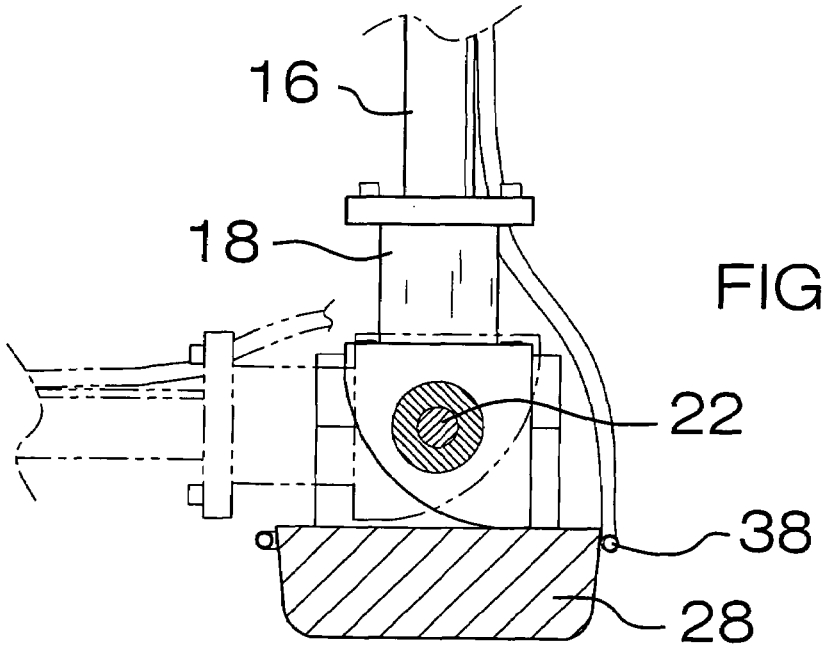
FIG. 6 is a cross-sectional view of the present invention taken along line 6-6 of FIG. 3.

The liquid supply assembly 32 includes a supply tank 34 coupled to the sleeve 16. The supply tank 34 stores the liquid to be sprayed on the asphalt. A valve 36 is coupled to the sleeve 16 and in fluid communication with the supply tank 34. The valve 36 controls a flow of the fluid from the supply tank 34 when the valve 36 is actuated. A sprayer 38 is coupled to the foot assembly 20 and extends around a perimeter of the foot assembly 20. The sprayer 38 is in fluid communication with the valve 36. The sprayer 38 sprays the liquid onto the asphalt around the foot assembly 20 when the valve 36 is actuated to allow the liquid to flow from the supply tank 34. FIG. 2, shows the pattern of the liquid being sprayed from the sprayer 38 when the foot assembly 20 is vibrated.

In use, the motor 12 is actuated to rotate the drive shaft 14. As the drive shaft 14 is rotated the transfer shaft 22 is rotated which rotates the weights 24. The off center orientation of the weights 24 creates a vibration in the foot assembly 20 and vibrates the tamping foot 28 which is positioned against the asphalt or the stone. The vibration of the tamping foot 28 tamps the asphalt or stone. As the tamping foot 28 is being drawn along the asphalt, the valve 36 may be actuated to allow the liquid in the supply tank 34 to be supplied to the sprayer 38 and sprayed onto the asphalt around the foot assembly 20 to inhibit the tamping foot 28 from sticking to the asphalt.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tamping device for tamping asphalt or stone placed on a surface, said device comprising:

a motor being coupled to a drive shaft, said motor rotating said drive shaft when said motor is actuated;

a sleeve being coupled to said motor, said drive shaft extending through said sleeve;

a transmission housing being coupled to said sleeve opposite said motor, said drive shaft extending into said transmission housing; and a foot assembly being rotatably coupled to said transmission housing, wherein an angle of said transmission housing and said sleeve is adjustable with respect to said foot assembly, said foot assembly vibrating when said motor is actuated to tamp the asphalt or the stone and said foot assembly is drawn across the asphalt or the stone.

2. The device according to claim 1, wherein said foot assembly includes a transfer shaft rotatably extending through said transmission housing, said transfer shaft engaging said drive shaft, wherein said drive shaft rotates said transfer shaft.

3. The device according to claim 2, wherein said transfer shaft is positioned orthogonally to said drive shaft.

4. The device according to claim 2, wherein said foot assembly includes a plurality of weights, each of said weights being coupled to said transfer shaft, each of said weights being positioned off center to vibrate said foot assembly when said transfer shaft is rotated, at least some of said weights extending in a different direction from said transfer shaft with respect to each other.

5. The device according to claim 4, wherein said foot assembly includes a tamping foot rotatably receiving said transfer shaft, said tamping foot abutting and vibrating against the asphalt or the stone to tamp the asphalt or the stone when said transfer shaft and said weights are rotated.

6. The device according to claim 1, further comprising a handle being coupled to said sleeve, said handle being graspable to facilitate manipulation of said sleeve, said motor and foot assembly.

7. The device according to claim 1, further comprising a liquid supply assembly being coupled to said sleeve, said liquid supply assembly spraying a liquid on the asphalt around said foot assembly to inhibit said foot assembly from sticking to the asphalt.

8. The device according to claim 7, wherein said liquid supply assembly includes a supply tank being coupled to said sleeve, said supply tank storing the liquid to be sprayed on the asphalt.

9. The device according to claim 8, wherein said liquid supply assembly includes a valve being coupled to said sleeve and in fluid communication with said supply tank, said valve controlling a flow of the fluid from said supply tank when said valve is actuated.

10. The device according to claim 9, wherein said liquid supply assembly includes a sprayer being coupled to said foot assembly and extending around a perimeter of said foot assembly, said sprayer being in fluid communication with said valve, said sprayer spraying the liquid onto the asphalt around said foot assembly when said valve is actuated to allow the liquid to flow from said supply tank.

11. A tamping device for tamping asphalt or stone placed on a surface, said device comprising:

a motor being coupled to a drive shaft, said motor rotating said drive shaft when said motor is actuated;

a sleeve being coupled to said motor, said drive shaft extending through said sleeve;

a transmission housing being coupled to said sleeve opposite said motor, said drive shaft extending into said transmission housing;

a foot assembly being rotatably coupled to said transmission housing, wherein in an angle of said transmission housing and said sleeve is adjustable with respect to said foot assembly, said foot assembly comprising;

a transfer shaft rotatably extending through said transmission housing, said transfer shaft engaging said drive shaft, wherein said drive shaft rotates said transfer shaft, said transfer shaft being positioned orthogonally to said drive shaft;

a plurality of weights, each of said weights being coupled to said transfer shaft, each of said weights being positioned off center to vibrate said foot assembly when said transfer shaft is rotated, at least some of said weights extending in a different direction from said transfer shaft with respect to each other;

a tamping foot rotatably receiving said transfer shaft, said tamping foot abutting and vibrating against the asphalt or stone to tamp the asphalt or the stone when said transfer shaft and said weights are rotated;

a handle being coupled to said sleeve, said handle being graspable to facilitate manipulation of said sleeve, said motor and foot assembly;

a liquid supply assembly being coupled to said sleeve, said liquid supply assembly spraying a liquid on the asphalt around said foot assembly to inhibit said foot assembly from sticking to the asphalt, said liquid supply assembly comprising;

a supply tank being coupled to said sleeve, said supply tank storing the liquid to be sprayed on the asphalt;

a valve being coupled to said sleeve and in fluid communication with said supply tank, said valve controlling a flow of the fluid from said supply tank when said valve is actuated; and a sprayer being coupled to said foot assembly and extending around a perimeter of said foot assembly, said sprayer being in fluid communication with said valve, said sprayer spraying the liquid onto the asphalt around said foot assembly when said valve is actuated to allow the liquid to flow from said supply tank.

* * * * *